US011673251B2

(12) United States Patent
Schneider et al.

(10) Patent No.: US 11,673,251 B2
(45) Date of Patent: Jun. 13, 2023

(54) COOLING DEVICE FOR A HAND-HELD POWER TOOL

(71) Applicant: Robert Bosch GmbH, Stuttgart (DE)

(72) Inventors: Dietmar Schneider, Denkendorf (DE); Elmar Feder, Leonberg (DE); Manfred Lutz, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 268 days.

(21) Appl. No.: 16/883,987

(22) Filed: May 26, 2020

(65) Prior Publication Data

US 2020/0376644 A1 Dec. 3, 2020

(30) Foreign Application Priority Data

May 29, 2019 (DE) ..... 10 2019 207 977.6

(51) Int. Cl.
*B25F 5/00* (2006.01)
*B24B 23/00* (2006.01)
*B25F 5/02* (2006.01)

(52) U.S. Cl.
CPC ..... *B25F 5/008* (2013.01); *B24B 23/005* (2013.01); *B25F 5/02* (2013.01)

(58) Field of Classification Search
CPC ..... B25F 5/008; B25F 5/02
See application file for complete search history.

(56) References Cited

U.S. PATENT DOCUMENTS 6,127,751 A * 10/2000 Kristen ..... H02K 7/14 173/117
6,602,122 B1 8/2003 Rudolf et al.
9,132,542 B2 * 9/2015 Lau ..... B25F 5/008
9,882,452 B2 * 1/2018 Haga ..... B25F 5/008
2002/0034682 A1 * 3/2002 Moores, Jr. ..... H01M 10/482 429/71
2004/0124721 A1 * 7/2004 Pfisterer ..... H02K 11/05 310/58
2006/0186743 A1 8/2006 Habel et al.
2006/0266538 A1 * 11/2006 Stierle ..... B24B 23/028 173/217
2008/0290745 A1 * 11/2008 Riedl ..... B25F 5/008 310/60 R
2010/0270877 A1 * 10/2010 Esenwein ..... H02K 7/145 310/62
2011/0148227 A1 * 6/2011 Schuele ..... B25F 5/008 310/50

(Continued)

FOREIGN PATENT DOCUMENTS

DE 10 2005 007 545 A1 8/2006
DE 10 2008 001 250 A1 10/2009
JP 2010269409 A * 12/2010 ..... B24B 23/028

*Primary Examiner* — Nathaniel C Chukwurah
*Assistant Examiner* — Lucas E. A. Palmer
(74) *Attorney, Agent, or Firm* — Maginot, Moore & Beck LLP

(57) ABSTRACT

A cooling device for a hand-held power tool, in particular an angle grinder, includes a first air guide channel configured to guide a first airflow and a first air inlet opening configured to guide the first airflow into a housing of the hand-held power tool. The first airflow is guided such that the first airflow extends/flows from the first air inlet opening to a side of the housing that faces away from the first air inlet opening.

20 Claims, 10 Drawing Sheets

(56) References Cited

U.S. PATENT DOCUMENTS

| | | | | |
|---|---|---|---|---|
| 2011/0308828 | A1* | 12/2011 | Shinma | B25F 5/008 173/114 |
| 2016/0229045 | A1* | 8/2016 | Hashimoto | B25D 17/043 |
| 2017/0136614 | A1* | 5/2017 | Takeda | B24B 23/02 |
| 2017/0239804 | A1* | 8/2017 | Matsushita | H02K 11/33 |
| 2017/0361416 | A1* | 12/2017 | Lutz | B25F 5/008 |
| 2019/0099873 | A1* | 4/2019 | Zhang | H02K 5/161 |
| 2019/0262971 | A1* | 8/2019 | Kondo | H02K 11/0094 |
| 2019/0273421 | A1* | 9/2019 | Velderman | H02K 9/227 |
| 2020/0331138 | A1* | 10/2020 | Ejiri | B24B 23/02 |
| 2021/0060754 | A1* | 3/2021 | Tadokoro | B25F 5/008 |

* cited by examiner

COOLING DEVICE FOR A HAND-HELD POWER TOOL

This application claims priority under 35 U.S.C. § 119 to patent application no. DE 10 2019 207 977.6, filed on May 29, 2019 in Germany, the disclosure of which is incorporated herein by reference in its entirety.

BACKGROUND

The disclosure relates to a cooling device.

DE 10 2005 007 545 A1 discloses a device for cooling a set of electronics, in particular a set of control electronics, of a hand-held power tool, the device having an air guide means by which at least a portion of an airflow emerging from an electric motor is routed to the set of electronics.

SUMMARY

The disclosure is based on the object of improving a cooling device for a hand-held power tool, in particular an angle grinder, by simple design measures.

The object is achieved by a cooling device for a hand-held power tool, in particular an angle grinder, having a first air guide channel for guiding a first airflow, and having a first air inlet opening that is designed to guide the first airflow into a housing of the hand-held power tool.

It is proposed that the first airflow be guided in such a manner that the first airflow extends, or flows, from the first air inlet opening to a side of the housing that faces away from the first air inlet opening.

An item designed in such a manner allows particularly advantageous guiding of the airflow, for example to enable cooling of internal components located adjacent to the air inlet opening and extending to a side of the housing that faces away from the first air inlet opening. The airflow in this case can be guided along, in particular, an entire extent of the components, such that at least one side of the components can be cooled by the airflow. The airflow is designed to flow substantially perpendicularly in relation to the air inlet opening, in particular an opening face of the air inlet opening.

Preferably, the first airflow is designed to flow into the housing through the first air inlet opening, and to be guided, by means of the first air guide channel, from the first air inlet opening substantially to a side that faces away from the first air inlet opening. The first air guide channel may have an extent that extends from the first air inlet opening to the side that faces away from the first air inlet opening. The first air guide channel may extend, in particular, substantially perpendicularly in relation to the housing. The first air guide channel may have an extent, in particular in a direction perpendicular to the first air inlet opening, or an opening face of the first air inlet opening. The housing may have a distance from the first air inlet opening to a side of the housing that faces away from the first air inlet opening. In particular, the first air guide channel extends by more than 70%, in particular more than 80%, preferably more than 90%, preferably more than 95%, and/or less than 98%, in particular less than 95%, preferably less than 90%, with respect to the distance inside the housing. The first airflow may be designed to flow transversely, in particular perpendicularly, in relation to an, in particular notional direct, connection, in particular a connecting line, from the first air inlet opening to an air outlet opening. The first airflow may be designed to flow transversely, in particular perpendicularly, in relation to a main extent of the hand-held power tool.

The first air guide channel is preferably formed from a plurality of components and/or channel portions that surround the housing and arranged in relation to each other in such a manner that the first airflow flows along this air guide channel.

The housing may have a single air inlet opening or a plurality of air inlet openings. The housing may have a single air outlet opening or a plurality of air outlet openings. The openings (air inlet opening, air outlet opening) may be realized as material through-holes that open a housing from an exterior to an interior. The material through-hole may be designed to allow an airflow of ambient air from an external environment, through the material cut-out, into the interior of the hand-held power tool. The material through-hole may be designed to allow an airflow of ambient air from an interior of the hand-held power tool, through the material through-hole, to an external environment. An airflow in this case is to be understood to be a directed current of air that, in particular, is designed to provide a cooling effect on the interior of the hand-held power tool. A directed current is to be understood to mean, in particular, a substantially straight current. The air inlet opening may be arranged on a side of the housing that is opposite the air outlet openings. A drive unit and/or an electronics unit may be arranged between the first air inlet opening and the air outlet opening.

The first air inlet opening is arranged at a first end of the hand-held power tool. The air outlet opening is arranged at a second end of the hand-held power tool that faces away from the first end. Preferably, the first airflow is designed to flow along the hand-held power tool, in particular along a main extent thereof, from the first end to the second end.

To generate the airflow, the cooling device may have a fan unit. It may be expedient for the fan unit to have a fan impeller element that, in an operating state, forms a directed current. The fan unit may have a single fan impeller element or a plurality of fan impeller elements. The fan impeller element may be arranged in the housing. The fan impeller element may be surrounded by the housing. The fan impeller element may have a plurality of fan impeller blades that are spaced apart from each other in the circumferential direction. The fan unit may form a directed airflow in such a manner that the air inlet opening has an intake airflow, and the air outlet opening has a discharge airflow. A particularly reliable and compact cooling device can thereby be achieved.

The dependent claims specify further expedient developments of the cooling device according to the disclosure.

It may be expedient for the first air guide channel to be connected to the first air inlet opening. In particular, the first air inlet opening is substantially delimited by the first air guide channel. Preferably, the first air guide channel surrounds the first air inlet opening, at least substantially. Preferably, the first air inlet opening adjoins the first air guide channel. The first air guide channel may delimit the air inlet opening. The first air guide channel may extend between the first air inlet opening, on a first side, and the housing, on a side that faces away from the first side. A particularly homogeneous airflow, for cooling the hand-held power tool, can thus be achieved in a particularly simple manner.

Further, it may be expedient for the cooling device to have a sealing element, in particular realized as a single piece with the housing, that is designed to delimit the first air guide channel. In particular, the sealing element is realized as a housing wall that extends transversely, in particular perpendicularly, in relation to the housing. Preferably, the sealing element is realized as a single piece with the housing. Preferably, the sealing element is arranged between the air inlet opening and the internal component. The sealing element may have a stop element that is designed to be in contact with the internal component and, in particular, effect sealing with respect to the first airflow. The sealing element may be designed to support, or position, the internal component in the housing. Preferably, the sealing element is designed to act in combination with the internal component in such a manner that the first airflow is directed into the first air guide channel, or does not flow between the sealing element and the internal component, at least not to any significant extent. The sealing element may be realized as a contacting or non-contacting seal. The sealing element may be realized as a labyrinth sealing element. The sealing element may be designed to be in contact with an internal component in such a manner that an airflow between the sealing element and the inner component is minimized, in particular avoided. This makes it possible to prevent the airflow, after flowing through the air inlet opening, from flowing in the direction of main extent of the hand-held power tool, but instead first in a direction transverse, in particular perpendicular, to the direction of main extent, and then in the direction of main extent, or substantially parallel thereto.

Furthermore, it may be expedient for the cooling device to have an electronics unit for controlling the hand-held power tool, in particular a drive unit of the hand-held power tool, by open-loop and/or closed-loop control, the electronics unit delimiting the first air guide channel. In particular, the first air guide channel is arranged and/or realized in such a manner that at least the first airflow over the electronics unit is guided along a side of the electronics unit. The first airflow may be designed to cool the electronics unit. The first air guide channel may be formed, at least partially, by the electronics unit. In particular, the electronics unit constitutes an internal component. Preferably, the electronics nit overlaps the first air inlet opening, at least partially. A first section through the first air inlet opening, along a plane extending from the first air inlet opening to a side of the housing that faces away from the first air inlet opening, intersects the first air guide channel and the electronics unit. A section through the first air inlet opening, along a plane extending from the first air inlet opening to a side of the housing that faces away from the first air inlet opening, intersects the first air guide channel, and in particular not the electronics unit. The first section in this case is parallel to the second section. In this way, the airflow can be diverted in such a manner that flow is effected fully around at least one side of the electronics unit, thereby enabling the electronics unit to be cooled in a particularly reliable manner. The drive unit is preferably realized as an electronically commutated drive unit. The electronics unit is preferably designed to control the drive unit by open-loop and/or closed-loop control.

Furthermore, it may be expedient for the cooling device to have a first air routing opening that is arranged in an inner region of the housing and surrounded by the housing. The inner region is preferably separated from an outer region of the hand-held power tool by the housing. In particular, the inner region comprises a region of the hand-held power tool that is separated from the housing of the hand-held power tool. The first air routing opening may be delimited by the housing and the electronics unit. The first air routing opening may be designed to guide the first airflow through the first air routing opening. The first air routing opening may be connected to the first air guide channel. The first air routing opening may be arranged on a side of the housing that faces away from the first air inlet opening. The first air routing opening may extend transversely, in particular perpendicularly, in relation to the first air inlet opening. The first airflow can thereby be guided particularly easily, for example along the electronics unit.

It is proposed that the first air routing opening be arranged on a side of the housing that faces away from the first air inlet opening. In particular, the first air inlet opening may be fluidically connected, or connected by means of the first airflow, to the first air routing opening. The first airflow in this case flows past the electronics unit. In this way, the first airflow can be made to flow in a particularly effective manner through the hand-held power tool.

It is further proposed that the cooling device have a second air inlet opening that is designed to form a second airflow in the housing. It is further proposed that the cooling device have a second air inlet opening that is designed to form a second air guide channel for guiding the second airflow. In particular, the second air guide channel is arranged parallel to the first air guide channel. Preferably, the second air guide channel is approximately similar in design to the first air guide channel. Preferably, the second air inlet opening is approximately similar in design to the first air inlet opening. Effective cooling can thereby be achieved.

It is further proposed that the second air inlet opening be arranged on a side of the first air inlet opening that faces away from the first air inlet opening. Preferably, the first air routing opening is arranged in a region of the second air inlet opening. Preferably, the second air routing opening is arranged in a region of the first air inlet opening. It is thereby possible, in a particularly reliable manner, to realize a cooling device that, in the case of a covered, or closed, first air inlet opening, ensures that an airflow is guided through the opposite air inlet opening.

It may be expedient for the second air guide channel to be connected to the second air inlet opening. Preferably, the second air routing opening is approximately similar in design to the first air routing opening.

Further, it may be expedient for the second air guide channel to be separated from the first air guide channel, in particular by a separating element. In particular, the separating element may be a dividing wall. Preferably, the separating element is designed to separate the first air guide channel from the second air guide channel. Preferably, the separating element extends parallel to the first and/or the second air guide channel. Preferably, the separating element is realized as a holding element that is designed to hold, or position, the electronics unit with respect to the housing. The separating element is realized as a separating extension. The separating element delimits the first and/or the second air guide channel, in particular in a direction transverse, in particular perpendicular, to a direction of the first and/or second airflow. It is thereby possible to form particularly advantageous separate air guide channels that, independently of each other, provide cooling of the hand-held power tool.

Further, it may be expedient for the cooling device to have an air guide element, in particular realized as an air guide plate, that is designed to delimit the first and/or the second air guide channel. The air guide element may be arranged opposite the cooling element. The air guide element may be arranged parallel to the cooling element. The air guide element and the cooling element may be spaced apart by the separating element. The air guide element may delimit the hand-held power tool. The air guide element may be arranged at the second end 27 of the second housing part 19. The air guide element may be realized as a single piece with the housing of the hand-held power tool. The air guide element may be arranged, as a separate housing part, between the first and the second housing part. The air guide element may be designed to delimit an accumulator battery interface for an accumulator battery device, on a side that faces away from the cooling element.

Furthermore, it may be expedient for the second airflow to flow in a direction opposite to that of the first airflow. In particular, the first airflow flows past the second airflow. Cooling can thus be ensured, even if the first and/or the second air inlet opening are/is covered and no airflow can pass.

Furthermore, it may be expedient for the electronics unit to have a cooling element, in particular a cooling fin, that is designed to cool the electronics unit. In particular, the first airflow and/or the second airflow are/is guided parallel to the cooling element, in particular the cooling fin. In this way, particularly advantageously, the electronics unit can be cooled by the airflow.

It is proposed that the cooling element delimit the first and/or second air guide channel, and have the first and/or second airflow flowing around it.

The disclosure additionally relates to a hand-held power tool having a cooling device, and having a, in particular electronically commutated, drive unit.

BRIEF DESCRIPTION OF THE DRAWINGS

Further advantages are given by the following description of the drawings. The drawings show exemplary embodiments of the disclosure. The drawings, the description, and the claims contain numerous features in combination. Persons skilled in the art will expediently also consider the features individually, and combine them to form appropriate further combinations. There are shown:

DETAILED DESCRIPTION

In the following figures, components that are the same are denoted by the same references.

Figure 1:
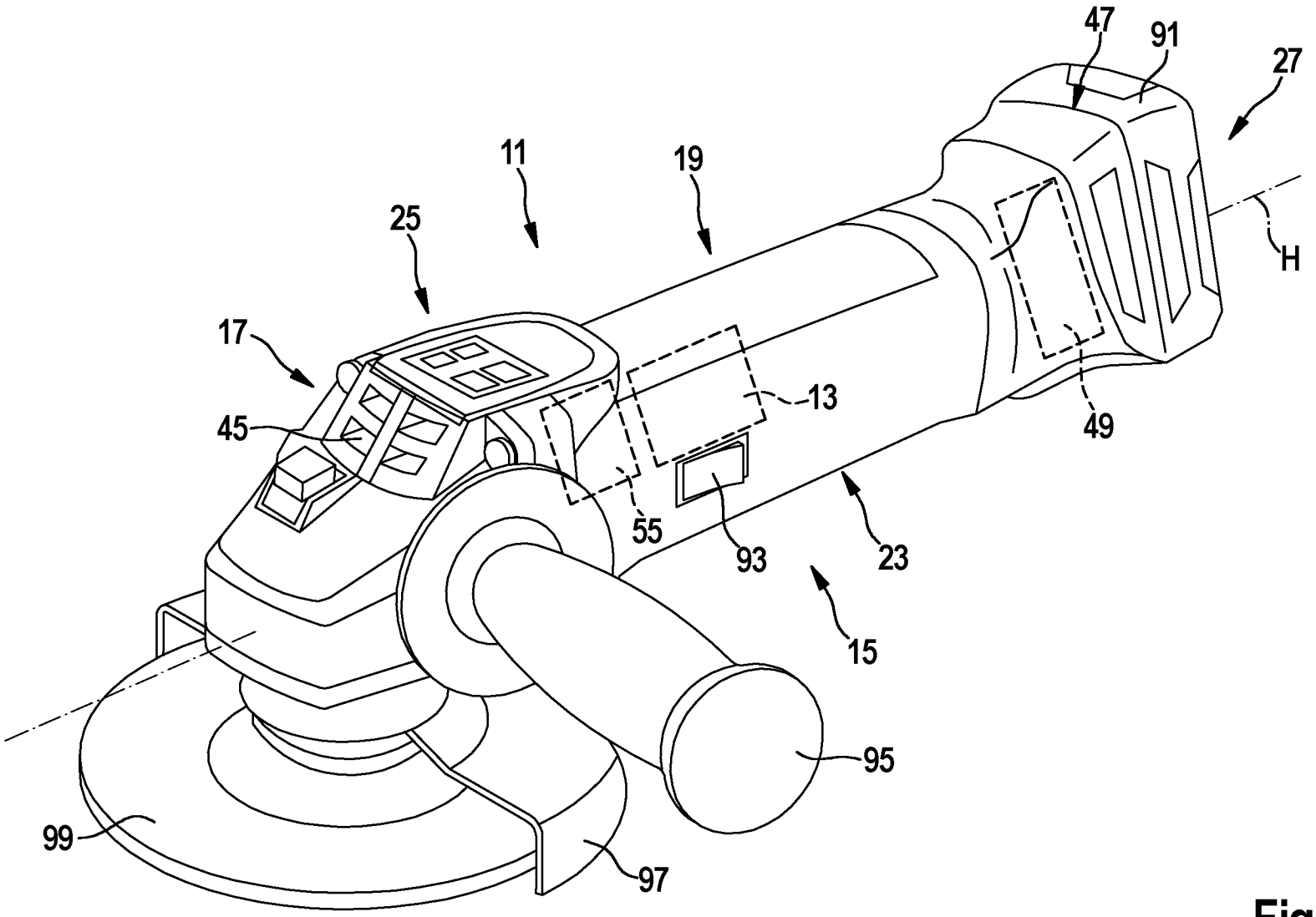
FIG. 1 a perspective view of a hand-held power tool.
Figure 2:
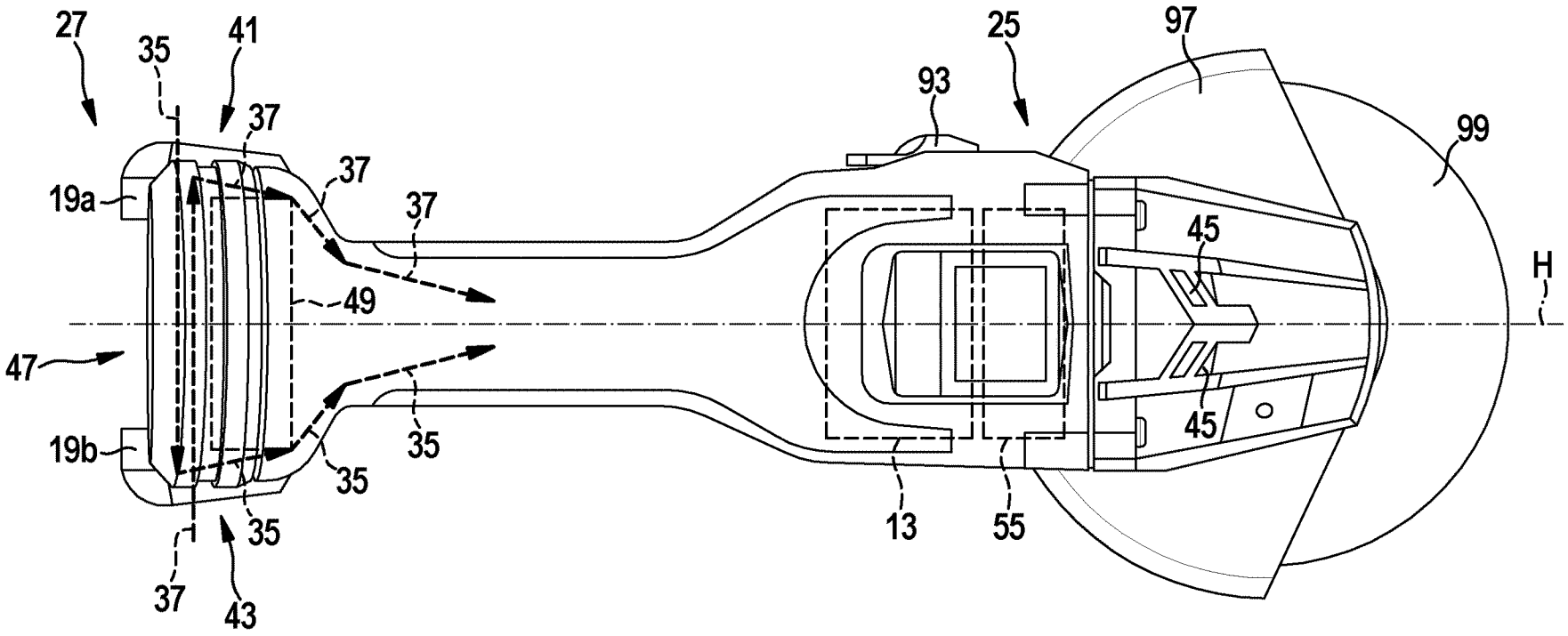
FIG. 2 a further view of the hand-held power tool from FIG. 1.
Figure 3:
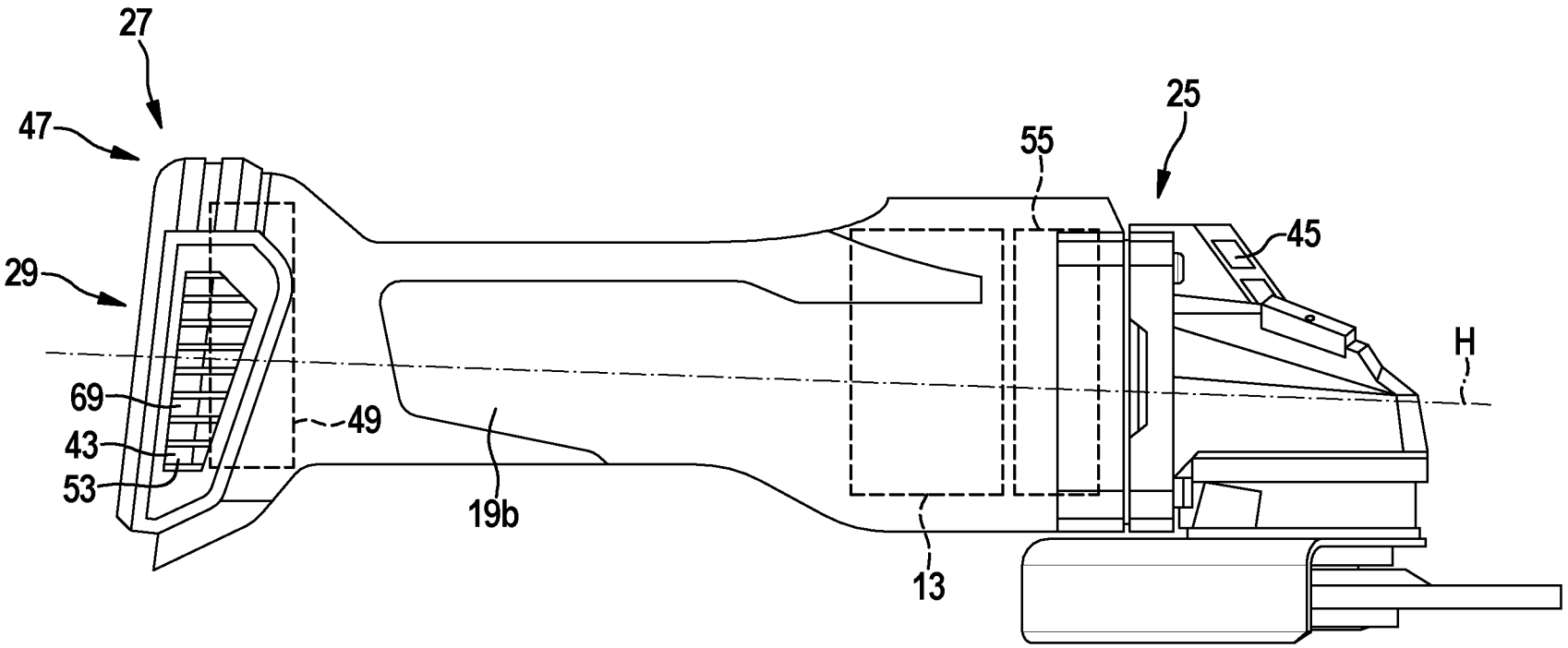
FIG. 3 a further view of the hand-held power tool from FIG. 1.
Figure 4:
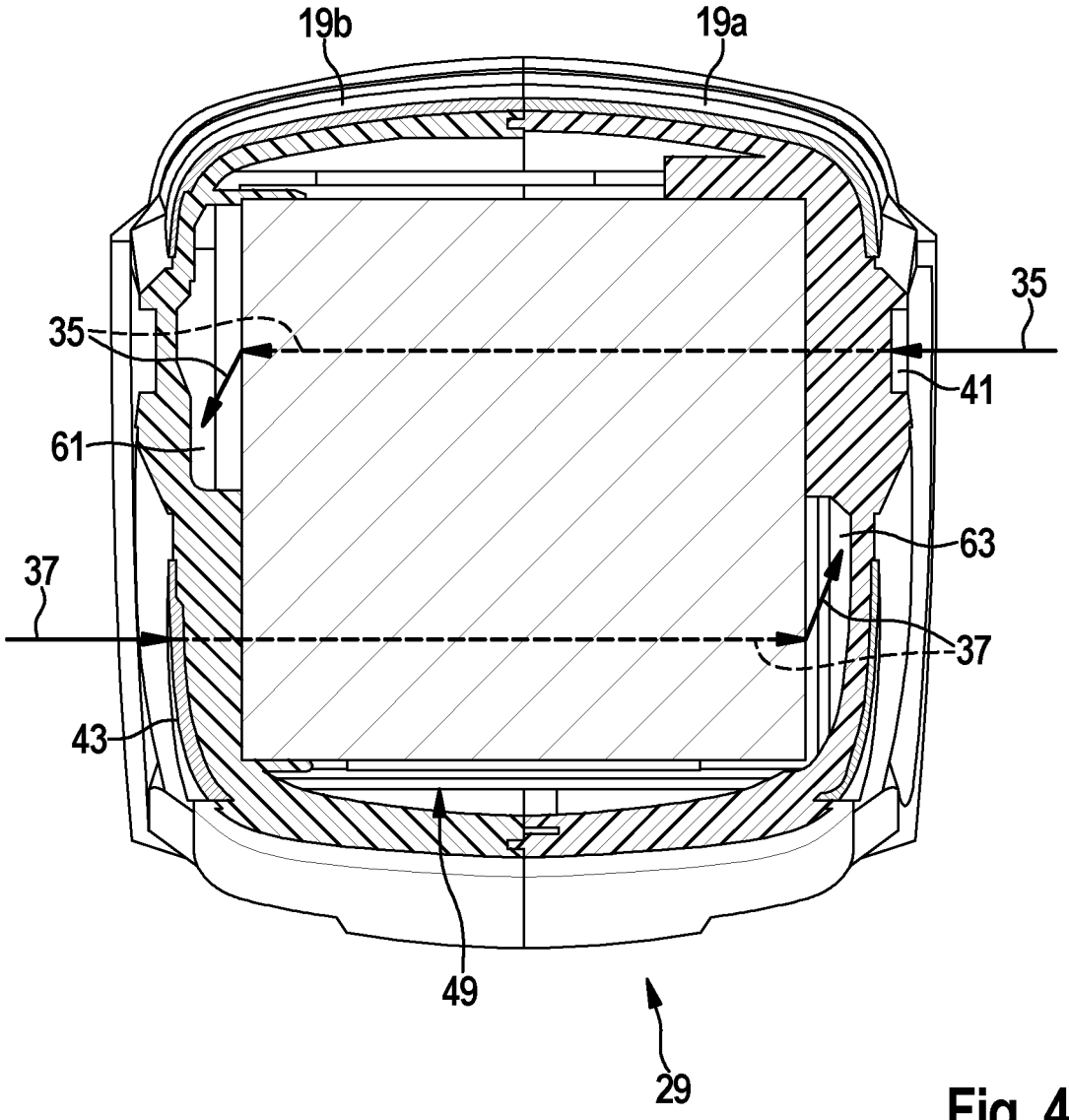
FIG. 4 a section A-A through the hand-held power tool.
Figure 5:
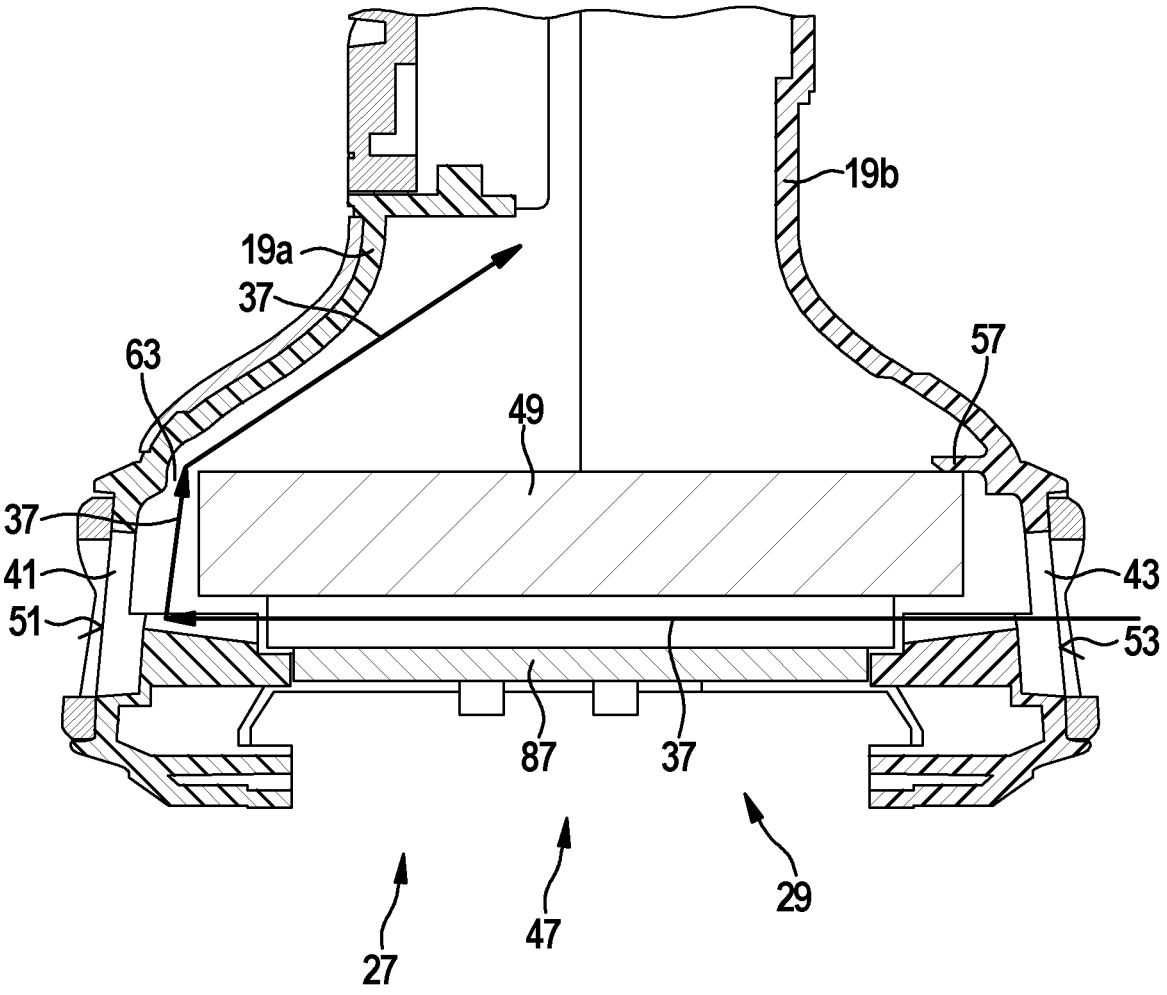
FIG. 5 a section B-B through the hand-held power tool.
Figure 6:
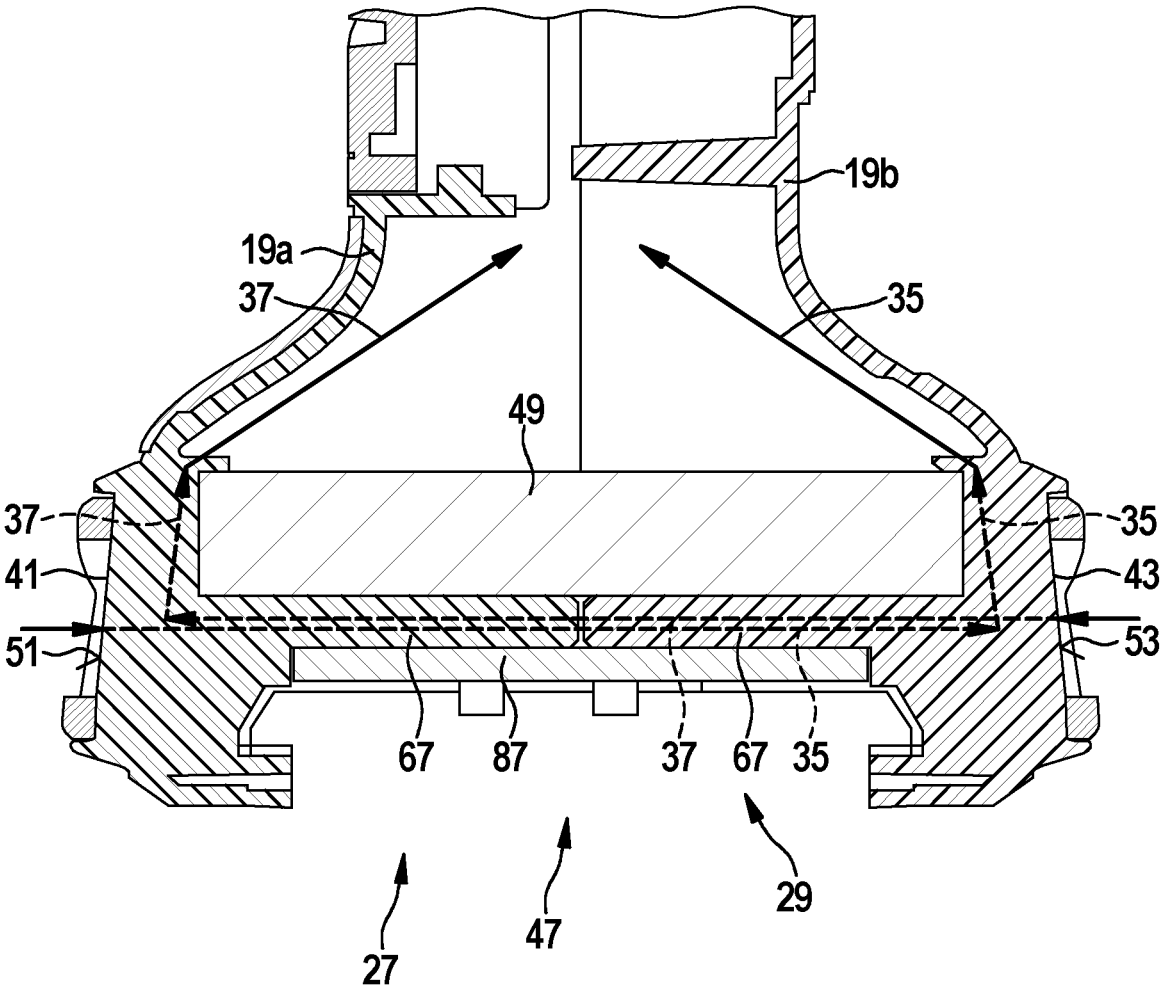
FIG. 6 a section C-C through the hand-held power tool.
Figure 7:
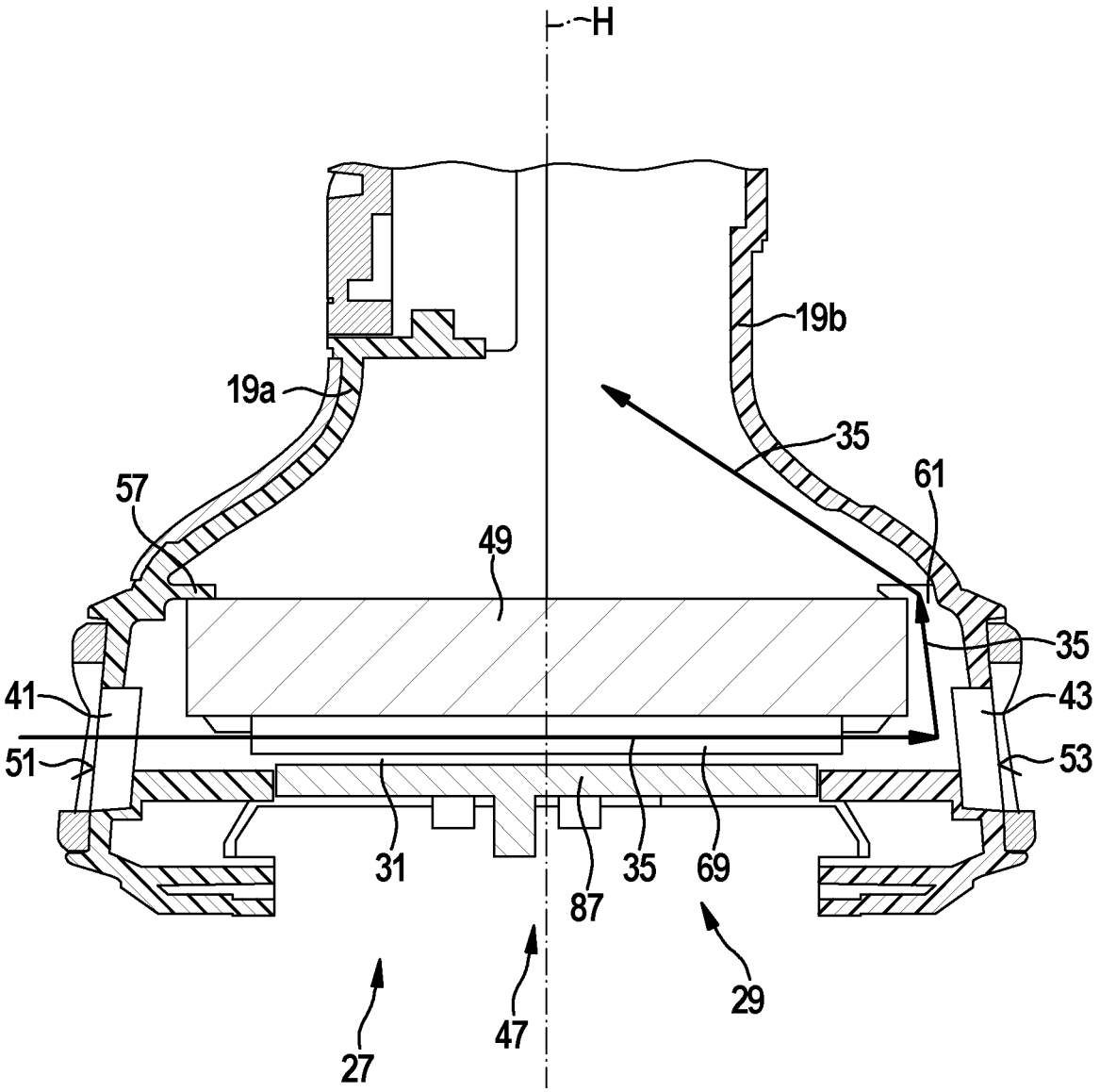
FIG. 7 a section D-D through the hand-held power tool.
Figure 8:
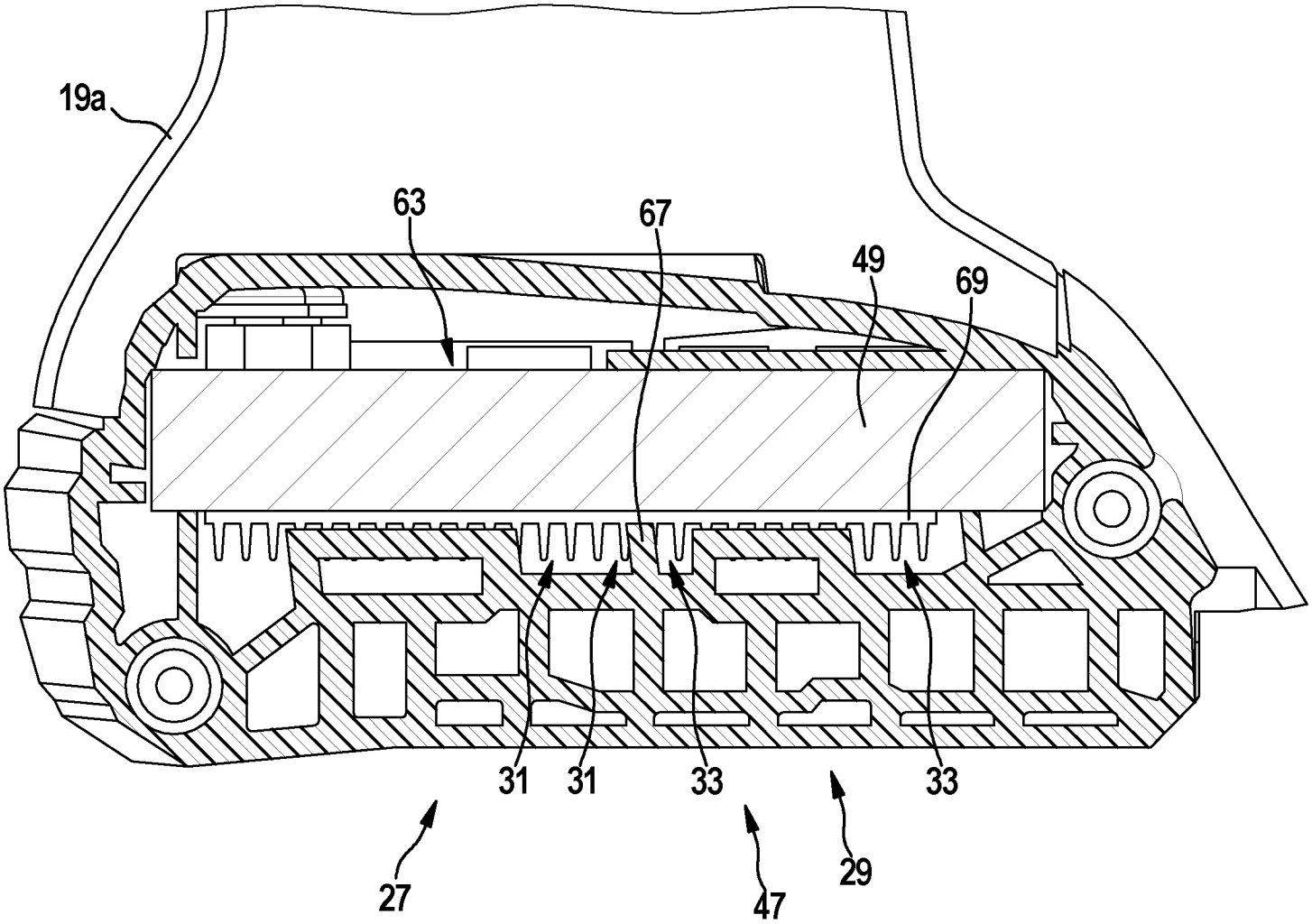
FIG. 8 a section G-G through the hand-held power tool.
Figure 9:
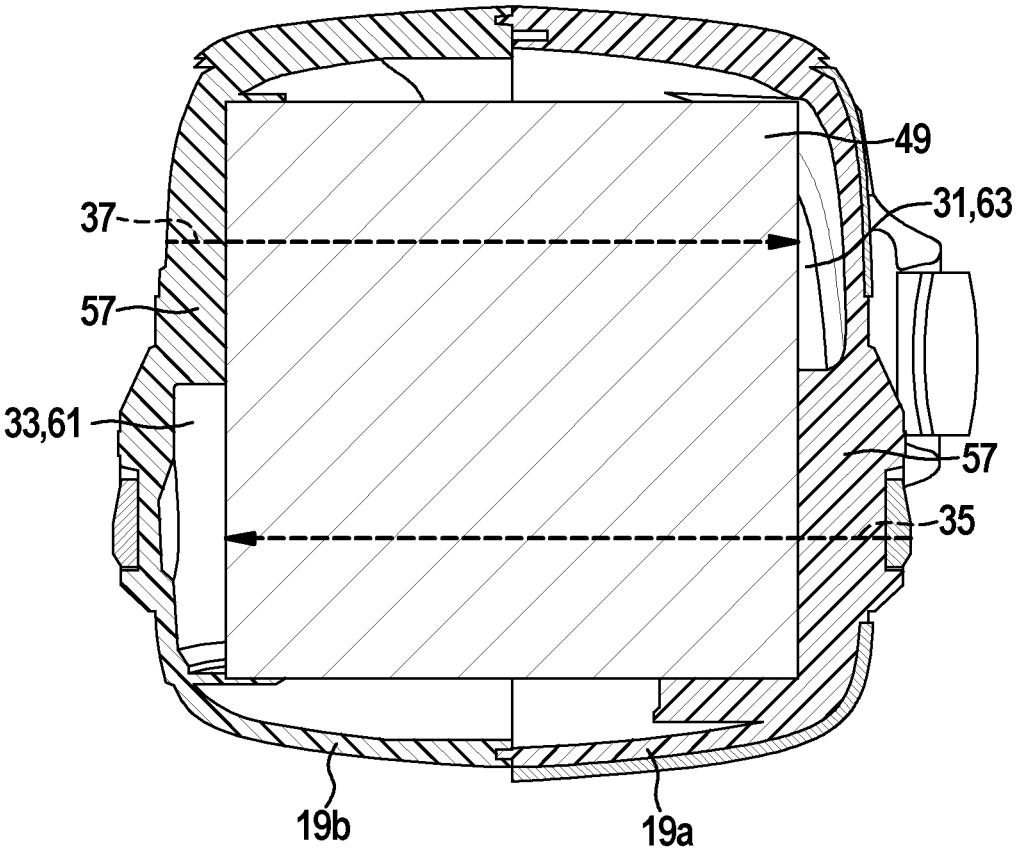
FIG. 9 a section E-E through the hand-held power tool.
Figure 10:
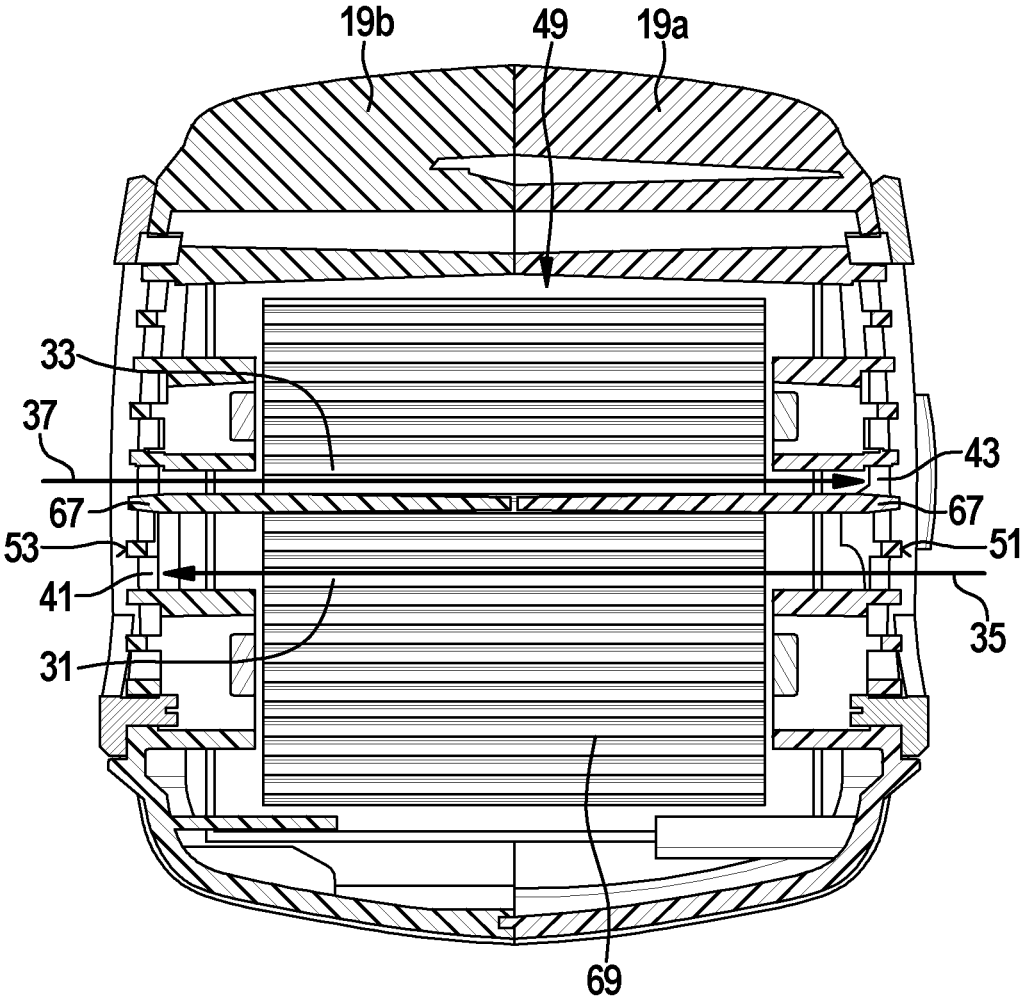
FIG. 10 a section F-F through the hand-held power tool.

FIG. 1 shows a hand-held power tool 11 realized as an angle grinder, comprising a drive unit 13, comprising a power-tool housing 15, and comprising a drive unit 13 realized as an electronically commutated electric motor. The power-tool housing 15 forms an outer housing of the hand-held power tool 11. The power-tool housing 15 has a first housing part 17, realized as a transmission housing, and a second housing part 19 that surrounds the drive unit 13. The second first housing part 17 surrounds a transmission unit 24, and is made of a metal.

The second housing part 19 surrounds the drive unit 13, and additionally comprises a grip region 23 for gripping the hand-held power tool 11. The second housing part 19 is designed to be gripped by an operator.

The second housing part 19 is formed from two housing half-shells 19*a*, 19*b*. The second housing part 19 has a first end 25 that adjoins the first housing part 17, and has a second end 27, facing away from the first end 25, that can be connected to an accumulator battery device 91 realized as an accumulator battery pack. The second housing part 19 additionally comprises an actuating element 93, realized as an on/off switch, that is designed to switch the drive unit 13 on/off. The hand-held power tool 11 additionally has an ancillary handle 95 and a protective hood 97, and has an accessory tool 99, realized as a grinding disk, that is at least partially surrounded by the protective hood 97.

The hand-held power tool 11 has a cooling device 29, having a first air guide channel 31, for guiding a first airflow 35, and having a first air inlet opening 41 that is designed to guide the first airflow 35 into the second housing part 19 of the hand-held power tool.

The cooling device 29 has a second air guide channel 33, for guiding a second airflow 37, and has a second air inlet opening 43 that is designed to guide the second airflow 37 into the second housing part 19 of the hand-held power tool 11.

The first air inlet opening 41 and the second air inlet opening 43 are arranged in the end 27 of the second housing part 19 that is adjacent to the accumulator battery device. The first air inlet opening 41 and the second air inlet opening 43 are arranged adjacent to an interface 47 for receiving the accumulator battery device.

The cooling device 29 has an air outlet opening 45, arranged at the first end 25 of the second housing part 19. The air outlet opening 45 is arranged in the first housing part 19. Alternatively or additionally, the air outlet opening 45 may be arranged at the first end 25 of the second housing part 19. The two air inlet openings 41, 43 and the air outlet opening 45 are arranged on mutually opposite sides of a main extent H of the hand-held power tool 11, such that it can be ensured that the first and/or the second airflow 35, 37 flows substantially along the entire extent of the hand-held power tool 11.

The cooling device 29 has an electronics unit 49 for controlling the hand-held power tool 11, a drive unit of the hand-held power tool, by open-loop and/or closed-loop control. The electronics unit 49 delimits the first air guide channel 31. In particular, the first air guide channel 31 is arranged and/or realized in such a manner that at least the first airflow 35 over the electronics unit 49 is guided along a side of the electronics unit 49. The first airflow 35 is designed to cool the electronics unit 49. The first and/or the second air guide channel 31, 33 is formed, at least partially, by the electronics unit 49. In particular, the electronics unit 49 forms an internal component. Preferably, the electronics unit 49 at least partially overlaps the first and/or the second air inlet opening 41, 43. A first section through the first and the second air inlet opening 41, 43, along a plane extending from the first air inlet opening 41 to the second air inlet opening 43, intersects the first and the second air guide channel 31, 33 and the electronics unit 49. A second section through the first and the second air inlet opening 41, 43, along a plane extending from the first air inlet opening 41 to the second air inlet opening 43, intersects the first and the second air guide channel 33, and in particular not the electronics unit 49. The first section in this case is parallel to the second section.

The first end 25 of the second housing part forms a top end 25, and the second end 27 of the second housing part forms a bottom end 27.

The two air guide channels 31, 33 are surrounded by the housing of the hand-held power tool.

The second air inlet opening 43 is arranged on a side of the second housing part 19 that faces away from the first air inlet opening 41. The first air inlet opening 41 is realized in a first housing half-shell 19*a*, and the second air inlet opening 43 is realized in a second housing half-shell 19*b*.

The first airflow 35 is guided in such a manner that the first airflow 35 extends from the first air inlet opening 41 to a side of the second housing part 19 that faces away from the first air inlet opening 41. The first airflow 35 is guided in the second housing part 19 so as to enable cooling of internal components such as, for example, an electronics unit 49, that are arranged adjacently to the first air inlet opening 41, and extend to a side of the housing part 19 that faces away from the first air inlet opening 41. The first airflow 35 is guided along an underside of the entire extent of the electronics unit 49, such that at least the underside of the electronics unit 49 is cooled by the airflow 35, 37. The airflow 35, 37 is designed to flow substantially perpendicularly in relation to an opening face 51 of the first air inlet opening 41.

The first airflow 35 is designed to flow through the first air inlet opening 41 into the second housing part and, by means of the first air guide channel 31, from the first air inlet opening 41 substantially to the second air inlet opening 43. The first air guide channel 31 has an extent that extends from the first air inlet opening 41 to the second air inlet opening 43. The first air guide channel 31 extends substantially perpendicularly in relation to the housing. The first air guide channel 31 has an extent in a direction perpendicular to an opening face 51 of the first air inlet opening 41. The first air inlet opening 41 is spaced at a distance from the second air inlet opening 43. Arranged between the first air inlet opening 41 and the second air inlet opening 43 are the air guide channels, which extend substantially from the first air inlet opening 41 to the second air inlet opening 43, or from the second air inlet opening 43 to the first air inlet opening 41. The first and the second air guide channel 31, 32 extend by more than 80% with respect to the distance of the two mutually opposite air inlet openings 41, 43. This prevents the airflow 35, 37 from flowing in the direction of a first end 25 of the second housing part directly after flowing into the housing.

The first airflow 35 is designed to flow, substantially perpendicularly in relation to a main extent H of the hand-held power tool, from the first air inlet opening 41 in the direction of the second air inlet opening 43, and then to flow, substantially parallel to the main extent H of the hand-held power tool, from the first air inlet opening 41 in the direction of the air outlet opening 45.

The first and the second air guide channel 33 are formed from a plurality of components and channel portions, surrounding the housing, that are arranged in relation to each other in such a manner that the first airflow 35 flows along this air guide channel 31.

The second housing part has a plurality of first air inlet openings 41 and a plurality of second air inlet openings 43 that in each case are arranged parallel to each other. The first housing part 19 has two air outlet openings 45. The air inlet openings 41, 43 and the air outlet openings 45 are realized as material through-holes that go through the respective housing from an exterior to an interior and/or vice versa. It is understood that the material through-holes are designed to enable an airflow 35, 37 of ambient air from an external environment, through the material through-holes, into the interior of the hand-held power tool, and vice versa.

To generate the airflow 35, 37, the cooling device 29 has a fan unit 55, having a fan impeller element that, in an operating state, forms a directed current, and that is arranged in the housing, or surrounded by it. The fan unit 55 has a plurality of fan impeller blades that are spaced apart from each other in the circumferential direction. The fan unit 55 is designed to generate a negative pressure in the hand-held power tool in order to form a directed airflow 35, 37, in particular in such a manner that the air inlet opening 41, 43 has an intake airflow and the air outlet opening has a discharge airflow.

The first air guide channel 31 or the second air guide channel 33 is connected to the first air inlet opening 41 or the second air inlet opening 43, respectively. The first air inlet opening 41 or the second air inlet opening 43 is delimited substantially by the first air guide channel 31 or the second air guide channel 33, respectively. The first air guide channel 31 or the second air guide channel 33 surrounds the first air inlet opening 41 or the second air inlet opening 43, respectively, at least substantially. The first air inlet opening 41 or the second air inlet opening 43 adjoins the first air guide channel 31 or the second air guide channel 33, respectively. The first air guide channel 31 or the second air guide channel 33 delimits the first air inlet opening 41 or the second air inlet opening 43, respectively. The first air guide channel 31 or the second air guide channel 33 extends between the first air inlet opening 41, in particular the first housing half-shell 19*a*, and the second air inlet opening 43, in particular the second housing half-shell 19*b*.

The cooling device 29 has a sealing element 57, in particular realized as a single piece with the housing, that is designed to delimit the first air guide channel 31. The sealing element 57 is realized as a housing wall that extends, substantially perpendicularly in relation to the housing, into the interior. The sealing element 57 is realized as a single piece with the housing. The sealing element 57 is arranged, respectively, between the air inlet opening 41, 43 and the electronics unit 49. The sealing element 57 has a stop element that is designed to be in contact with the electronics unit 49 and effect sealing with respect to the first airflow 35. The sealing element 57 is designed to support, or position, the electronics unit 49 in the housing. The sealing element 57 is designed to act in combination with the electronics unit 49 in such a manner that the first airflow 35 is routed into the first air guide channel 31, or does not flow between the sealing element 57 and the electronics unit 49, at least not to any significant extent. The sealing element 57 is realized as a contacting seal. The sealing element 57 is designed to contact the electronics unit 49 in such a manner that an airflow 35, 37 between the sealing element 57 and the internal component is minimized, in particular avoided. This makes it possible to ensure that the first airflow 35 is guided transversely, in particular perpendicularly, in relation to the direction of main extent H substantially to the second air inlet opening 43.

The cooling device 29 has a first air routing opening 61 and a second air routing opening 63, that are arranged inside the housing and surrounded by the housing. The first air routing opening 61 or second air routing opening 63 is delimited by the housing and the electronics unit 49. The first air routing opening 61 or second air routing opening 63 is connected to the first air guide channel 31 and designed to guide the first airflow 35 through the first air routing opening 61 or second air routing opening 63. The first air routing opening 61 or the second air routing opening 63 is arranged at the second air inlet opening 43 or at the first air inlet opening 41, respectively. The first air routing opening 61 or the second air routing opening 63 extends substantially perpendicularly, in particular perpendicularly in relation to a direction of main extent H of the hand-held power tool, in relation to the first air inlet opening 41 or second air inlet opening 43, respectively.

The first air inlet opening 41 or second air inlet opening 43 is fluidically connected, or connected by means of the first airflow 35 or the second airflow 37, respectively, to the first air routing opening 61 or the second air routing opening 63, respectively. The first airflow 35 or the second airflow 37 flows past the electronics unit 49.

The second air guide channel 33 is separated from the first air guide channel 31 by a separating element 67. The separating element is realized as a dividing wall. The separating element 67 is designed to separate the first air guide channel 31 from the second air guide channel 33. The separating element 67 extends parallel to the first and/or the second air guide channel 33. The separating element 67 is realized as a holding element that is designed to hold, or position, the electronics unit 49 with respect to the housing. The separating element 67 is arranged between two cooling fins. The separating element 67 is realized as a separating extension. The separating element 67 delimits the first and/or the second air guide channel 33 in a direction substantially perpendicular to a direction of the first and/or second airflow 35, 37.

The cooling device 29 has an air guide element 87, realized as an air guide plate, that is designed to delimit the first and/or the second air guide channel 31, 33. The air guide plate 87 may be arranged opposite the cooling element 69. The air guide plate 87 may be arranged parallel to the cooling element 69. The air guide plate 87 and the cooling element 68 may be spaced apart by the separating element 67. The air guide plate 87 may delimit the hand-held power tool. The air guide plate 87 may be arranged at the second end 27 of the second housing part 19. The air guide plate 87 may be realized as a single piece with the first and/or second housing part of the hand-held power tool. The air guide plate 87 may be arranged, as a separate housing part, between the first and the second housing part. The air guide plate may be designed to delimit an accumulator battery interface for an accumulator battery device 91, on a side that faces away from the cooling element 69.

The second airflow 37 flows in a direction opposite to that of the first airflow 35. The first airflow 35 flows past the second airflow 37.

The electronics unit 49 has a cooling element, realized as a cooling fin, that is designed to cool the electronics unit 49. The first airflow 35 and/or the second airflow 37 are/is guided parallel to the cooling fin.

The cooling element 69 delimits the first and the second air guide channel 33, and has the first and/or the second airflow 37 flowing around it.

What is claimed is:

1. A cooling device for a hand-held power tool, comprising:

a first air guide channel configured to guide a first airflow; and a first air inlet opening defined in a first side of a housing of the hand-held power tool and configured to guide the first airflow into the housing, wherein the first air inlet opening and the first air guide channel guide the first airflow from the first air inlet opening to a second side of the housing that is on an opposite side of a main extent of the housing from the first air inlet opening.

2. The cooling device according to claim 1, wherein the first air guide channel is connected to the first air inlet opening.

3. The cooling device according to claim 1, further comprising a sealing element configured to delimit the first air guide channel.

4. The cooling device according to claim 3, wherein the sealing element is configured as a single piece with the housing.

5. The cooling device according to claim 1, further comprising an electronics unit configured to control the hand-held power tool by one or more of open-loop control and closed-loop control, the electronics unit delimiting the first air guide channel.

6. The cooling device according to claim 5, wherein the electronics unit has a cooling fin configured to cool the electronics unit.

7. The cooling device according to claim 1, further comprising a first air routing opening arranged in an inner region of the housing and surrounded by the housing.

8. The cooling device according to claim 7, wherein the first air routing opening is arranged on the side of the housing opposite the first air inlet opening.

9. The cooling device according to claim 7, wherein the first air inlet opening is fluidically connected to the first air routing opening.

10. The cooling device according to claim 1, further comprising:

a second air inlet opening defined in the second side of the housing; and a second air guide channel, wherein the second air inlet opening and the second air guide channel guide the second airflow from the second air inlet opening to the first side of the housing.

11. The cooling device according to claim 10, wherein the second air guide channel is separated from the first air guide channel in a direction along the main extent of the housing by a separating element that runs between the first and second sides of the housing.

12. The cooling device according to claim 10, further comprising an air guide plate configured to delimit one or more of the first air guide channel and the second air guide channel.

13. The cooling device according to claim 11, wherein the second airflow flows in a direction opposite to a direction of the first airflow from the second side of the housing to the first side of the housing.

14. The cooling device according to claim 10, further comprising an electronics unit configured to control the hand-held power tool by one or more of open-loop control and closed-loop control, wherein:

the electronics unit has a cooling element configured to cool the electronics unit, the cooling element delimits one or more of the first air guide channel and the second air guide channel, and one or more of the first airflow and the second airflow flows around the cooling element.

15. The cooling device according to claim 10, wherein the first airflow and the second airflow, respectively, are guided in the first and second air guide channels in opposite directions, and the first and second air guide channels are separated from one another.

16. The cooling device according to claim 1, wherein the hand-held power tool is configured as an angle grinder.

17. The cooling device according to claim 1, further comprising an air outlet opening, wherein the first airflow is further guided from the second side of the housing along a direction of the main extent of the housing to the air outlet opening.

18. The cooling device according to claim 1, wherein the first and second sides of the housing are lateral sides of the housing.

19. A hand-held power tool, comprising:

an electronically commutated drive unit;

a housing extending along a main extent and having a first side and a second side that is on an opposite side of the main extent from the first side; and a cooling device, including:

a first air guide channel configured to guide a first airflow, and a first air inlet opening defined in the first side of the housing and configured to guide the first airflow into the housing of the hand-held power tool, wherein the first air inlet opening and the first air guide channel guide the first airflow from the first air inlet opening to the second side of the housing.

20. A cooling device for a hand-held power tool, comprising:

a first air guide channel configured to guide a first airflow; and a first air inlet opening configured to guide the first airflow into a housing of the hand-held power tool, the first airflow guided by the first air inlet opening and the first air guide channel such that the first airflow extends from the first air inlet opening in a direction substantially perpendicular to a main direction of extent of the housing to a side of the housing opposite the first air inlet opening, wherein the first air guide channel extends in the direction substantially perpendicular to the main extent of the housing by more than 70% of a lateral width of the housing.

* * * * *